US007426820B2

(12) United States Patent
Grassi et al.

(10) Patent No.: US 7,426,820 B2
(45) **Date of Patent: *Sep. 23, 2008**

(54) METHOD AND DEVICE FOR THE PRODUCTION OF A COVERED ELASTIC YARN AND FOR AUTOMATIC REPLACEMENT OF FEEDS SPOOLS

(75) Inventors: Nerino Grassi, Mantova (IT); Samuele Gorgaini, Mantova (IT)

(73) Assignee: Giudici S.p.A., Jesi, Ancona (IT)

( * ) Notice: Subject to any disclaimer, the term of this patent is extended or adjusted under 35 U.S.C. 154(b) by 333 days.

This patent is subject to a terminal disclaimer.

(21) Appl. No.: 10/553,063

(22) PCT Filed: Nov. 25, 2004

(86) PCT No.: PCT/IT2004/000650

§ 371 (c)(1),
(2), (4) Date: Oct. 12, 2005

(87) PCT Pub. No.: WO2005/054106

PCT Pub. Date: Jun. 16, 2005

(65) Prior Publication Data

US 2006/0277890 A1 Dec. 14, 2006

(30) Foreign Application Priority Data

Dec. 2, 2003 (IT) ..... BO2003A0727
Apr. 16, 2004 (IT) ..... FI2004A0089

(51) Int. Cl.
*D02G 3/36* (2006.01)

(52) U.S. Cl. ..... 57/6; 57/266; 57/267

(58) Field of Classification Search ..... 57/3, 57/6, 19, 266, 276, 280
See application file for complete search history.

(56) References Cited

U.S. PATENT DOCUMENTS 3,940,917 A 3/1976 Strachan (Continued)

FOREIGN PATENT DOCUMENTS

DE 43 25 993 2/1994

(Continued)

*Primary Examiner*—Shaun R Hurley
(74) *Attorney, Agent, or Firm*—McGlew & Tuttle, P.C.

(57) ABSTRACT

The device has: a first interlacing jet (19); a feed path of the covering yarn (FT) and a feed path of the elastic yarn (F1; F2) towards the first interlacing jet; supporting elements (37A, 37B) for spools of elastic yarn (R1, R2); winding members (54) to wind the composite yarn (FC) on the cop being formed (BC); an interruption device to interrupt feed of composite yarn to the cop being formed and start winding the composite yarn on a new winding tube. The supporting elements for the spools of elastic yarn are suitable to support at least a first spool of elastic yarn and at least a second spool of elastic yarn; associated with the first interlacing jet are a retaining member (20) to withhold an initial free end of the elastic yarn of the second spool and a deflecting element to withhold an initial portion of the second elastic yarn during delivery of the first elastic yarn to the interlacing jet; a sensor to detect interruption of feed of the first elastic yarn to the first interlacing jet; a control to control release of the initial portion after interruption of feed of the first elastic yarn has been detected.

46 Claims, 8 Drawing Sheets

U.S. PATENT DOCUMENTS

| | | | | |
|---|---|---|---|---|
| 4,430,780 | A | 2/1984 | Sear et al. | |
| 4,829,757 | A | 5/1989 | Canton | |
| 5,008,992 | A | 4/1991 | Gehrmann et al. | |
| 5,010,631 | A | 4/1991 | Ritter | |
| 5,146,660 | A | 9/1992 | Ritter | |
| 5,568,719 | A * | 10/1996 | Proctor | 57/225 |
| 5,970,593 | A | 10/1999 | Sear | |
| 6,370,858 | B1 * | 4/2002 | Mori | 57/6 |
| 6,393,817 | B1 | 5/2002 | Coró | |
| 6,848,151 | B2 * | 2/2005 | Bakker et al. | 28/271 |
| 6,880,212 | B2 * | 4/2005 | Bakker et al. | 28/271 |
| 6,880,319 | B2 * | 4/2005 | Zhu | 57/3 |
| 2006/0042220 | A1 * | 3/2006 | Maccabruni et al. | 57/264 |

FOREIGN PATENT DOCUMENTS

| | | |
|---|---|---|
| EP | 0 564 400 | 10/1993 |
| EP | 1 411 014 | 4/2004 |
| JP | 3279437 | 12/1991 |
| WO | WO 03/042437 | 5/2003 |

* cited by examiner

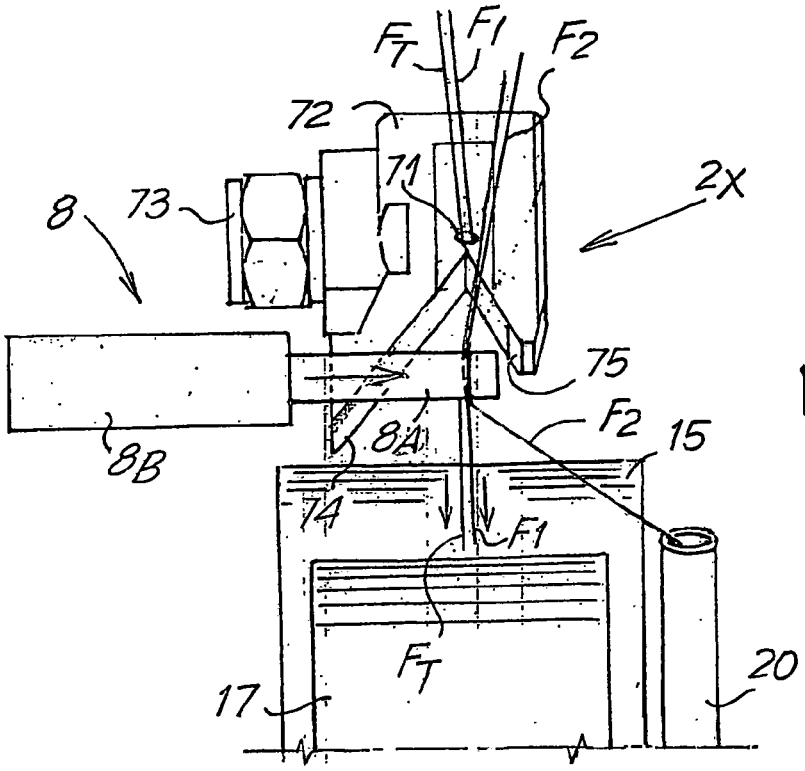
Fig.7A
Fig.7B
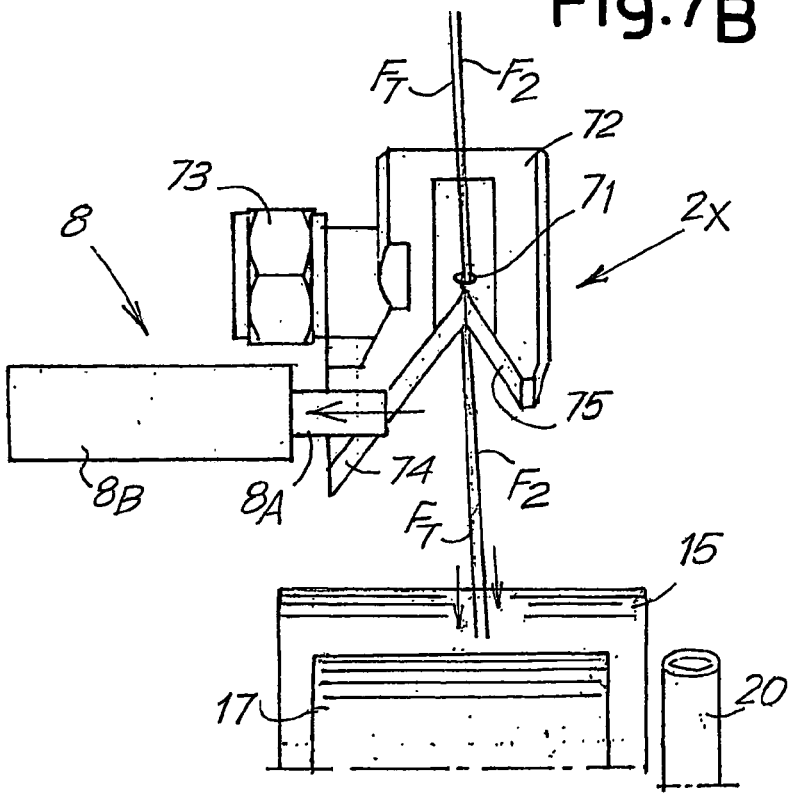

METHOD AND DEVICE FOR THE PRODUCTION OF A COVERED ELASTIC YARN AND FOR AUTOMATIC REPLACEMENT OF FEEDS SPOOLS

TECHNICAL FIELD

The present invention relates to a method and a device for the production of a composite yarn of the type comprising a core part, consisting of at least one elastic yarn, and an external coating, consisting of at least a covering or coating yarn, for example, an essentially non-elastic yarn or in any case a yarn with less elasticity than the core yarn.

More specifically, the invention relates to a method and a device that allows the spools of elastic yarn to be replaced in an automatic, simple and reliable way when they are finished or nearly finished.

STATE OF THE ART

Composite elastic yarns, consisting of an inner elastic yarn, such as a single filament yarn, made of Lycra®, Elastan, other polyurethane fibers or the like, are frequently used in the production of fabrics and particularly knitwear, such as hosiery. The elastic yarn is covered by a less elastic yarn, which may be considered essentially non-elastic, such as a Nylon®, or other polyamide, polyester or equivalent, typically with a multiple filament structure, that is, consisting of a plurality of strands. This yarn will henceforth be indicated as covering yarn as it is used to form a sort of coating or covering of the elastic yarn.

The coating of the elastic yarn may be obtained by means of a covering process in which the elastic yarn is coated with a helical winding of covering yarn. This process is extremely costly and slow.

A new process of coating or covering elastic yarns has recently become popular. This process, known as interlacing or air covering, consists in using a pneumatic device, commonly called interlacing jet, with a conduit through which the two covering and elastic yarns pass. A pressurized air nozzle delivers a jet of compressed air inside the conduit. The turbulence produced inside the conduit causes interlacing of the covering yarn around the elastic yarn. Devices and methods based on this technology are described in U.S. Pat. No. 6,393,817, U.S. Pat. No. 5,008,992, U.S. Pat. No. 4,829,757 and U.S. Pat. No. 3,940,917.

This technology uses pneumatic systems originally developed for processing multiple filament threads to increase bulk and simultaneously combine the single filaments of which they are composed. Examples of interlacing jets developed for this application and which can be used to interlace elastic or elastomer yarns with covering or coating yarns are described in U.S. Pat. No. 5,970,593, U.S. Pat. No. 5,146,660, U.S. Pat. No. 5,010,631, U.S. Pat. No. 4,430,780, EP-B-564400 and JP-A-3279437.

The spools of elastic or elastomer yarn used in systems for the production of covered elastic yarn contain much less yarn than that of the spools or cops of covering yarn. Typically, the elastic yarn on one spool is sufficient to produce a single cop of composite yarn, while the covering yarn wound on one cop is sufficient to make several cops of composite yarn. This makes it necessary to change the spools of elastic yarn frequently, between two subsequent covering or coating yarn cop changes. Replacement is manual. In a system generally equipped with a plurality of individual heads, each producing a cop of composite yarn, end-of-yarn sensors are provided to interrupt head operation when the respective spool of elastic yarn is finished. The operator must manually replace the finished spool of elastic yarn, and insert the free end of the new elastic yarn into the interlacing jet to start the winding cycle of a new cop of composite yarn. In manual systems, the operator must also replace the completed cop with a new tube on which the new composite yarn is wound. The delivery of covering yarn is interrupted during this operation.

This operating method has considerable drawbacks. Firstly, there are noteworthy downtimes, as a single operator monitors a large number of working heads and therefore considerable time may elapse between the spool of elastic yarn finishing and the operation of the operator that allows the head to start the subsequent winding cycle. Furthermore, specifically to avoid excessive machine downtimes, in some cases the spools of composite yarn may be replaced before they are completely finished. The residual yarn cannot be used. This means that a considerable amount of elastic yarn is wasted, representing a significant drawback in view of the high cost per unit of length of this material.

On the other hand, it is not possible for the operator to prepare a spare spool of composite yarn in advance and join the head or initial free end of the yarn of the spare spool to the tail of the yarn on the spool being processed, which would allow spool change to be prepared well before it ended and also to use up the entire spool being processed. This operation is not possible due to the fact that the spools of elastic yarn are not unwound holding them stationary, but must rotate about their axis to deliver the yarn wound thereon. Consequently, it is impossible for the operator to grasp the end or tail of the spool being processed and join it to the initial end of the yarn on the spare spool. This problem does not occur when replacing cops of covering yarn as the cops are unwound without rotating them about their axis. This allows head-to-tail joining of the yarns wound on cops intended to be unwound in sequence, ensuring continuous feed of the covering yarn. Furthermore, the cops of covering yarn contain a large amount of yarn and therefore joining operations are carried out at considerable intervals from one another.

Covering yarn texturing devices are provided between the yarn delivery cop and the interlacing jet in some systems (see U.S. Pat. No. 6,393,817 and U.S. Pat. No. 5,008,992 in particular). The texturing devices include an oven through which the covering yarn travels. This means that the yarn must be fed continuously. In fact, even temporary stopping of the yarn in the oven would cause the destruction or unacceptable damage thereof. When the head is stopped, even for only a short time, so that the operator can replace the finished spool of elastic yarn, the covering yarn must be cut upstream of the texturing section, that is, upstream of the oven. When the composite yarn forming head can start again, as the operator has completed the operations required to replace the spool and inserted the free end of the elastic yarn into the interlacing jet, he must re-thread the covering yarn through the entire path from the cop to the interlacing jet. This entails a lengthy downtime and therefore causes loss of production. The problem can only be prevented if the operator is capable of acting promptly to replace the spool of elastic yarn before the machine automatically cuts the covering yarn. As a large number of heads, which cannot be synchronized, are monitored by a single operator, it is never possible to act promptly enough on all heads in the system. Employing a higher number of operators, on the other hand, would involve an unacceptable increase in labor costs.

OBJECTS AND SUMMARY OF THE INVENTION

The object of the present invention is to provide an efficient and reliable method for automatic replacement of the spools of elastic yarn in devices for the production of covered elastic yarn, that is, composite yarn comprising an elastic core and a coating formed by one or more covering yarns.

According to a different aspect, the object of the present invention is to provide a device for the efficient and reliable continuous production of cops of composite yarn with automatic replacement of the elastomer spools without requiring to interrupt the covering yarn.

Essentially, according to a first aspect a method is provided comprising the phases of:

- feeding the covering yarn in an essentially continuous way along a feed path, through at least a first interlacing jet
- delivering a first elastic yarn from a first spool through the first interlacing jet;
- covering the first elastic yarn with said covering yarn to form the composite yarn and winding the composite yarn on a cop;
- preparing a second spool of a second elastic yarn in a stand-by position;
- withholding an initial portion of said second elastic yarn in proximity to said first interlacing jet;
- when delivery of the first elastic yarn is interrupted, replacing the cop of composite yarn with a new tube;
- releasing said initial portion of the second elastic yarn;
- joining said covering yarn and said second elastic yarn using the first interlacing jet;
- resuming production of the composite yarn covering the second elastic yarn with said covering yarn and winding the composite yarn on said new tube.

In a possible embodiment, the first interlacing jet is movable with respect to the yarns, such that joining of the covering yarn and the second elastic yarn by means of the first interlacing jet is obtained by moving the interlacing jet towards the second elastic yarn. The initial free end of the second elastic yarn is withheld by a retaining member while the second elastic yarn is in a stand-by position. When the second elastic yarn shall replace the first elastic yarn, the first interlacing jet is moved toward the second elastic yarn which enters the jet and is released from said retaining member.

In a further advantageous embodiment of the method according to the invention, the initial free end of the second elastic yarn is withheld by a retaining member, and the initial portion of the second elastic yarn can be engaged by a deflecting element. The latter is controlled to release the initial portion of the second elastic yarn when feed thereof towards the interlacing jet is required to start.

The deflecting element can be designed to withhold the second elastic yarn out of the first interlacing jet, while the second elastic yarn is disposed to be automatically inserted into said first interlacing jet when it is released from said deflecting element. Advantageously, the second elastic yarn can be inserted into the first interlacing jet through the effect of the tension exerted by the retaining member.

In a different embodiment, the second elastic yarn is inserted into the first interlacing jet and withheld therein, standing by for interruption of the first elastic yarn.

In a possible embodiment of the method according to the invention, when delivery of said first elastic yarn is interrupted, the first interlacing jet is temporarily made to stop operating while the covering yarn continues to be fed therethrough; after the second elastic yarn from the second spool starts to be delivered through the first interlacing jet, said first interlacing jet is re-activated to join the second elastic yarn to said covering yarn and resume production of said composite yarn. In this case a single interlacing jet is used both to produce the composite yarn and to start feeding the elastic yarn of the second spool. The second elastic yarn can already be standing by inside the first interlacing jet when feed of the first elastic yarn is interrupted.

In a different embodiment, the elastic yarn is instead covered with the covering yarn by a second interlacing jet, disposed downstream of the first interlacing jet along the path of the covering yarn. In this case the first interlacing jet has the sole function of constraining the second elastic yarn to the covering yarn when the empty spool is replaced with the new spool of elastic yarn. Therefore, the first jet can be activated only in the exchange phase and remains inoperative during the production of composite yarn by the second jet.

According to a different aspect, the invention relates to a method comprising the phases of:

(a) continuously feeding from the running machine or with the machine stopped a covering yarn to an air jet interlacing device;

(b) simultaneously feeding to said interlacing device a first elastomer yarn being unwound from a first spool, disposed in a working position, so as to obtain interlacing of said covering yarn with said elastomer yarn;

(c) withholding the free end of a second elastomer yarn, wound on a second spool, disposed in a stand-by position in a retaining area;

(d) detecting interruption of feed of said first elastomer yarn, to control, in appropriate time relationship, transfer of said second spool of elastomer yarn to said working position and transfer of said first spool of elastomer yarn to said stand-by position;

characterized in that includes the additional phases of:

(e) performing a relative movement of said covering yarn with respect to said second elastomer yarn, in proximity to said retaining area of said free end of the second elastomer yarn, so as to come into contact with said second elastomer yarn;

(f) associating said second elastomer yarn with said covering yarn using an air jet, simultaneously releasing said free end of the second elastomer yarn, to resume feed of said yarns to said interlacing device.

According to a different aspect of the invention, a device is provided for the production of a composite yarn formed by at least an elastic yarn covered with at least a covering yarn, comprising in combination: a first interlacing jet; a feed path of said covering yarn and a feed path of said elastic yarn towards said first interlacing jet; supporting means for spools of elastic yarn; winding members to wind the composite yarn on a cop being formed; an interruption device to interrupt feed of the composite yarn to said cop being formed and start winding the composite yarn on a new winding tube. Characteristically, said supporting means for the spools of elastic yarn are suitable to support at least a first spool of elastic yarn and at least a second spool of elastic yarn. Moreover, associated with said first interlacing jet are a retaining member to withhold an initial free end of the elastic yarn of said second spool. Also provided are a sensor to detect interruption of feed of the first elastic yarn to the first interlacing jet and a control to control release of the initial portion of the second elastic yarn when interruption of feed of the first elastic yarn is detected.

The retaining member can advantageously be a suction member.

According to a possible embodiment, means are provided to move one with respect to the other the first interlacing jet and the initial portion of the second elastic yarn when the latter is in a standby position. The second elastic yarn thus enters the first interlacing jet when the first elastic yarn has been interrupted.

According to a further embodiment, associated with the first interlacing jet is also a deflecting element to withhold an initial portion of the second elastic yarn during delivery of the first elastic yarn to the first interlacing jet.

According to a possible embodiment, the retaining member and the deflecting element are disposed, with respect to the first interlacing jet, so as to withhold the second elastic yarn out of the first interlacing jet. Moreover, the retaining member is designed and arranged to tension the second elastic yarn causing insertion thereof into the first interlacing jet when the deflecting element releases said second elastic yarn.

Further advantageous features and embodiments of the device and of the method according to the invention are indicated in the appended claims and shall be described in greater detail hereunder with reference to some exemplary embodiments.

BRIEF DESCRIPTION OF THE DRAWINGS

The invention shall now be better understood following the description and accompanying drawing, which shows practical non-limiting and exemplary embodiments of the invention. In particular, in the drawing:

FIGS. 7A and 7B show an approximate front view of the first interlacing jet in two operating conditions;

DETAILED DESCRIPTION OF EMBODIMENTS OF THE INVENTION

A first embodiment of the invention is shown in FIGS. 1 to 5.

Figure 1:
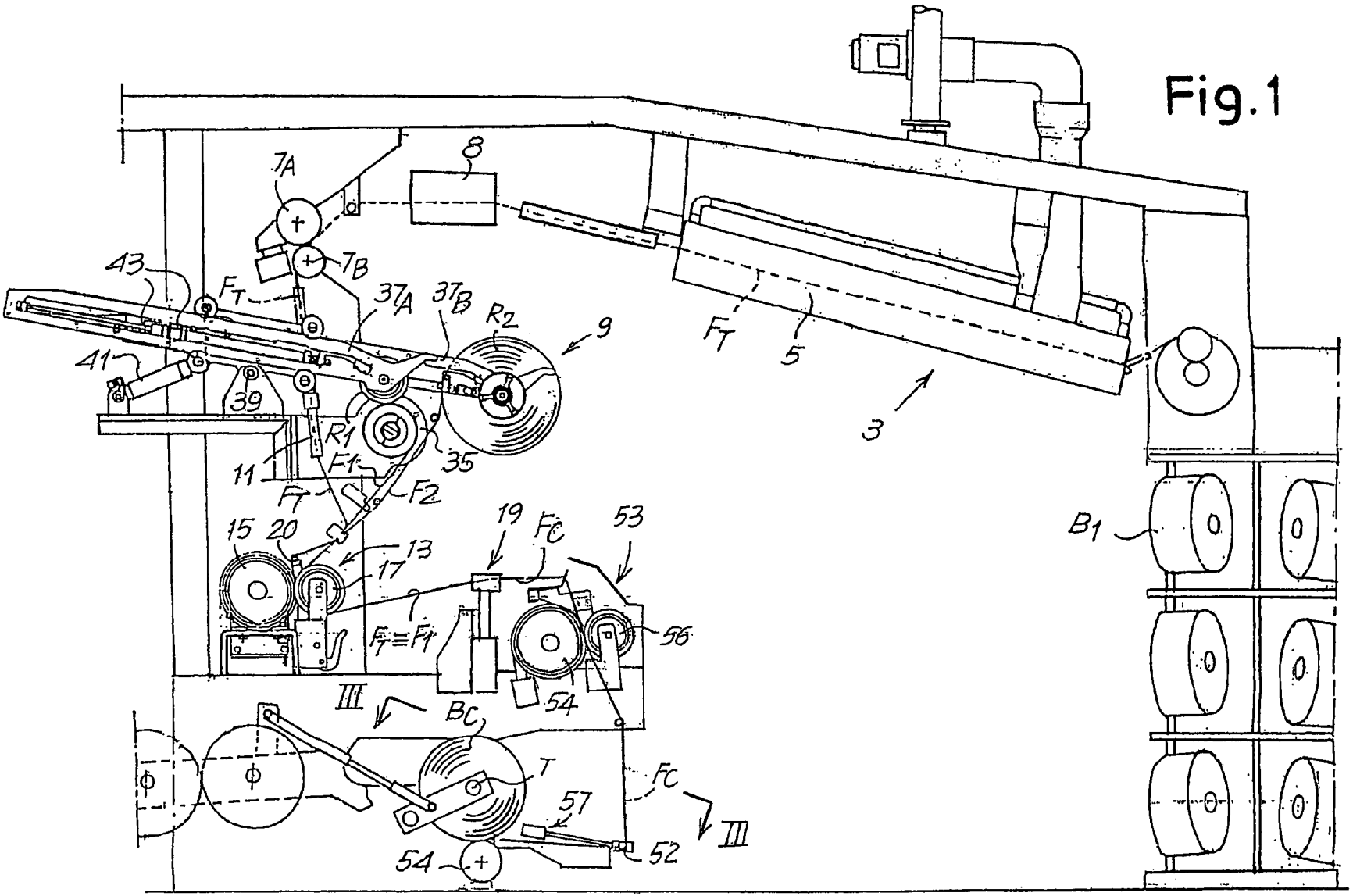
FIG. 1 shows a side view of the device complete with the texturing area of the covering yarn.

FIG. 1 shows a side view of a system comprising a plurality of winding heads to produce cops of composite yarn with a series of devices according to the invention. Only one head is shown in the figure, the others being aligned orthogonally to the plane of the figure.

The number 1 generically indicates the area in which the cops B1 of covering yarn, for example polyester, nylon or other equivalent yarns, typically a multiple filament yarn, are located. The yarn unwound from a cop B1 is fed through a texturing section of conventional type, known per se and indicated with 3. The texturing area has a heating oven 5, a cooling area 6, an area 8 for the false-twisting operation, and terminates with a first pair of rollers 7A, 7B to pick up or feed the textured covering yarn FT, which is fed to an area 9 in which the spools of elastic yarn, the interlacing jet, the actual winding head and all the members required to change the spools of elastic yarn are located. With the exclusion of the winding head, this area is shown in greater detail in FIG. 2.

In the area 9 the yarn FT passes through an oven 11 (to stabilize the yarn) and along its feed path Pft reaches an interlacing jet wherein it covers the elastic yarn F1 or F2 fed from one or other of the two spools R1, R2 carried by supporting means as described below.

A first interlacing jet 2 is disposed along the path Pft, for the purpose of joining the elastic yarn of a new spool to the textured covering yarn FT when a finished spool R1 is replaced with a new spool R2 of elastic yarn, according to a procedure to be described below. In the arrangement in FIG. 2, the interlacing jet 2 is normally inoperative and is only operated during the phase to start unwinding a new spool of elastic yarn. The inlet of the interlacing jet 2 is oriented in a direction slanted with respect to the direction from which the yarn FT is fed, so that it is guided inside the interlacing jet 2 by means of a fixed guide element 4, such as a ceramic thread guide with a low coefficient of friction.

Disposed downstream of the first interlacing jet 2 is a stretching area 13, in which a stretching unit or feed unit is provided, formed by a second pair of rollers 15,17, the first of which is driven and the second is idle, forming a nip through which the yarns are fed. The peripheral speed of the rollers 15 and 17 and the peripheral speed of the pair of rollers 7A, 7B are coordinated with each other to apply stretch or to relax the elastic and covering yarns.

Disposed downstream of the stretching unit 15, 17, is a second interlacing jet, indicated as a whole with 19, which may be of a type known per se, and which—in this embodiment—is the process jet, that is, the one that coats the elastic yarn by means of the covering yarn.

A first elastic yarn F1, unwound from a first spool R1 of elastic yarn is fed through the nip defined by the stretching rollers 15, 17 forming the stretching unit 13. The spool R1 is unwound by a driven unwinding roller 35 with which it is in contact. The speeds of the unwinding roller 35 and of the rollers 15, 17 are adjustable to apply the required degree of stretch to the yarn F1. Moreover, the speed of the rollers 15, 17 can be adjusted with respect to the speed of the pair of rollers 7A, 7B to apply a degree of stretch to the yarn FT which is either equal to or different than the stretch applied to the yarn F1, or also to slacken the yarn FT. The yarn F1 fed from the spool R1 passes through the first interlacing jet 2 adjacent to the textured covering yarn FT. As the jet 2 is inoperative during normal feed of the two yarns FT and F1, it has no action on these yarns.

The spool R1 is supported by an arm 37A oscillating about an axis 39 orthogonal to the plane of the figure. In addition to the oscillating movement, controlled by a piston-cylinder actuator 41, the arm 37A is provided with a translating movement in a direction parallel to the longitudinal extension of the arm, controlled by a further piston-cylinder actuator 43. A further arm 37B, essentially the same as the arm 37A, is hinged on the same axis 39, and its oscillating movement about the axis 39 is controlled by a further piston-cylinder actuator, not visible and hidden from view in FIG. 2 by the actuator 41. The arm 37B is also provided with a translating movement parallel to the longitudinal extension thereof, controlled by an actuator similar to the actuator 43 and not visible in the figure.

The oscillating arm 37B supports a second spool R2 on which a second elastic yarn F2 is wound. The spool R2 is (in the arrangement in FIG. 2) in a standby position to replace the spool R1 when the latter is finished. The position of the two arms 37A, 37B can be exchanged thanks to the oscillating and extending/retracting movements of the arms obtained with the actuators 41, 43.

The yarn F2 is prepared along a standby path which extends downwards from the spool R2 through the first interlacing jet 2 to a retaining member 20, which has a suction mouth, inside which the head or free end of the second elastic yarn F2 is inserted. A mechanical retaining system can be associated with the mouth of the retaining member 20, so that during standby before replacing the yarn F1 with the yarn F2, suction through the mouth can be deactivated and the free end of the yarn F2 is withheld only mechanically. During exchange of the two spools R1 and R2 the yarns F2 will, instead, be sucked by the mouth for reasons which shall later become apparent.

The retaining member 20 is adjacent to the pair of rollers 15, 17 and positioned rearwards with respect to the roller 17, that is, on the opposite side—with respect to the spool R2—of a vertical plane containing the axis of the roller 17.

Figure 2:
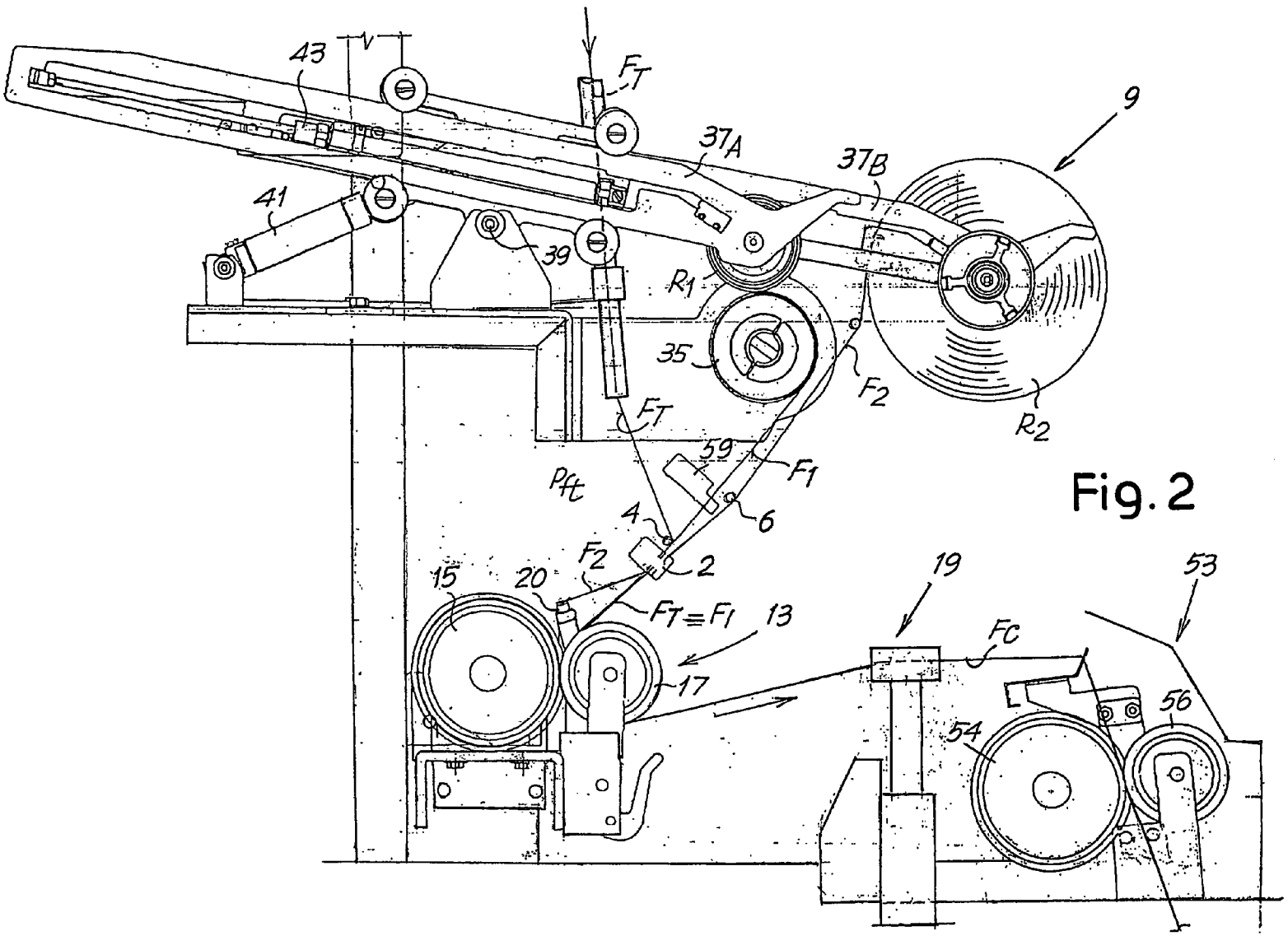
FIG. 2 shows a side view of a portion of the device.

Along its path from the spool R2 to the retaining member 20 the second elastic yarn F2 rests on a deflecting element 6 provided with a movement orthogonal to the plane in FIG. 2. The deflecting element can consist of a cylinder made of ceramic or another material with low coefficient of friction, connected to the rod of a piston-cylinder actuator. Retraction of the rod of the piston-cylinder actuator releases the second elastic yarn F2 from the deflecting element 6 when the finished spool R1 must be replaced with the spool R2, or when the yarn F1 breaks and must be replaced with the yarn F2.

The deflecting element 6 withholds the second elastic yarn F2 standing by out of the range of action of a sensor 59, disposed along the path of the elastic yarn F1, between the spool R1 and the first interlacing jet 2. The sensor 59, for example an optical sensor, detects passage of the elastic yarn F1 and provides a signal to start the cycle to replace the spool R1 with the spool R2, when delivery of the yarn F1 from the spool R1 is interrupted. By keeping the yarn F1 out of the range of detection of the sensor 59, this prevents operation of said sensor from being disturbed.

Downstream of the stretching unit 15, 17 the two yarns F1 and FT follow a common path to the second interlacing jet 19, inside which, in a way known per se, the elastic yarn F1 is covered with the yarn FT to form a composite or interlaced yarn FC.

Downstream of the interlacing jet 19 this composite yarn FC reaches the nip of a feed unit 53 formed by a third pair of rollers, consisting of a driven roller 54 and an idle roller 56. The peripheral speed of the rollers 54, 56 is connected to the speed of the rollers 15, 17 of the unit 13, so that the yarns F1 and FT and the yarn FC which are between these two pairs of rollers are subjected to the desired degree of relaxing and/or stretching.

Downstream of the feed unit 53 the yarn FC is deflected and guided by a fork 52 and reaches a winding area, indicated as a whole with 55, where it is wound on a winding tube T to form a cop BC of composite yarn. Positioned in the winding area 55 are mechanisms, known per se and not described herein, which automatically unload the cops BC as they are completed and replace each completed cop BC with a new winding tube T. The number 57 generically indicates a device which: interrupts the composite yarn FC at the end of winding a cop BC; withholds, with a suction mouth, the yarn which continues to be delivered during the phase to replace the cop BC with a new winding tube T and to replace the spool of elastic yarn R1 with the spool R2; and resumes winding of the yarn FC on the new winding tube f. The device 57 is shown in greater detail in the views in FIGS. 3, 4 and 5, which represent it in three different operating positions, according to III-III in FIG. 1.

Figure 3:
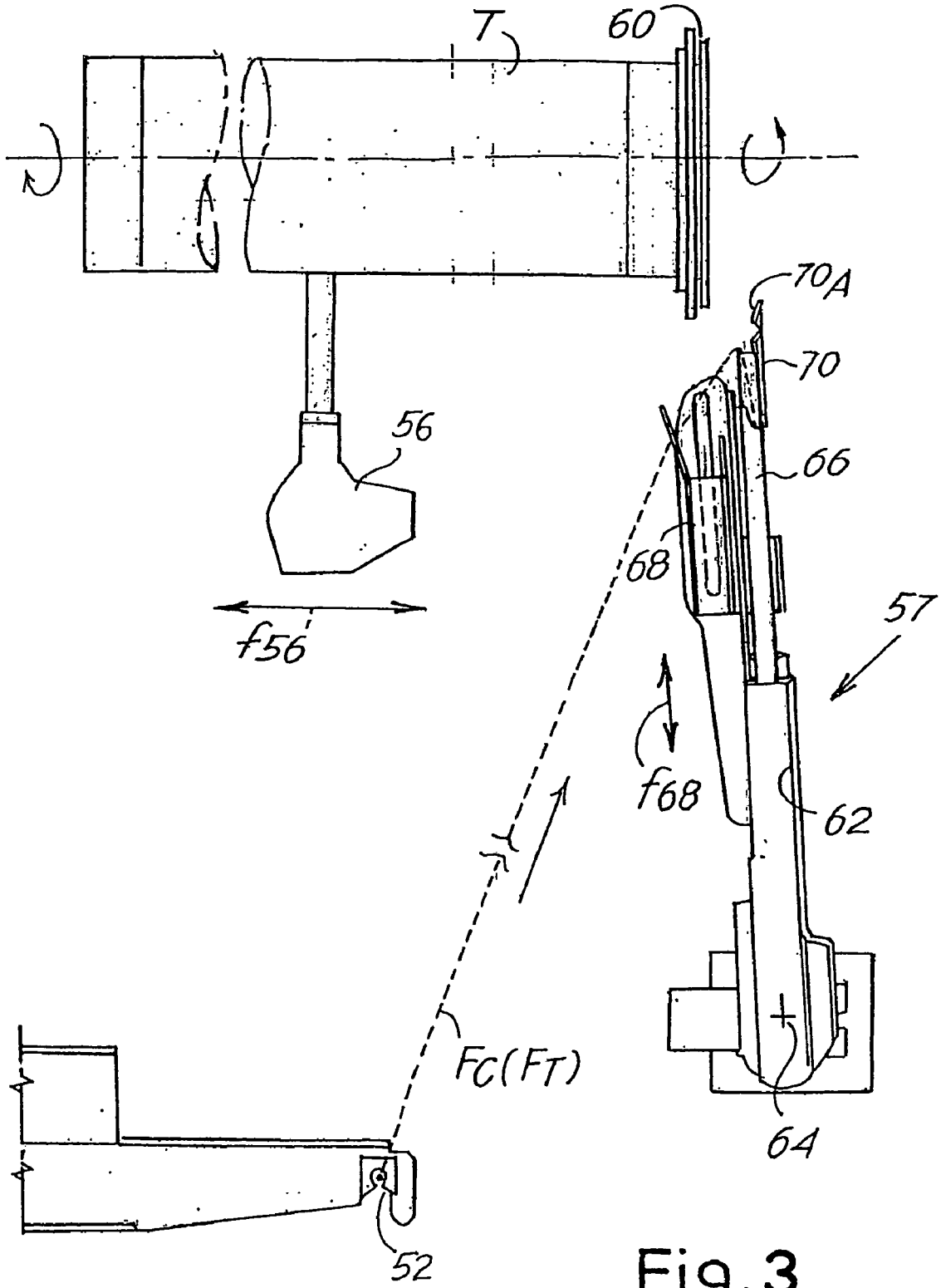
FIGS. 3, 4 and 5 show, in various arrangements, a view according to III-III in FIG. 1 of the winding area of the cop of composite yarn.

In FIG. 3 the device 57 is shown in standby position before starting to wind a new cop BC of interlaced yarn FC. The reference T indicates the tube which is used for winding and 60 indicates a ring, known per se, coaxial to the tube T and used to start winding the yarn on the tube. The tube T and the cop BC being formed thereon are made to rotate by a driven roller 54 positioned underneath (see FIG. 1), to ensure a constant peripheral speed as the diameter of the cop being formed varies. The number 56 indicates a thread guide or "traverse device" which with an alternating oscillating or translating movement according to the double arrow f56 distributes the turns of yarn on the tube T and on the cop BC being formed thereon.

Figure 4:
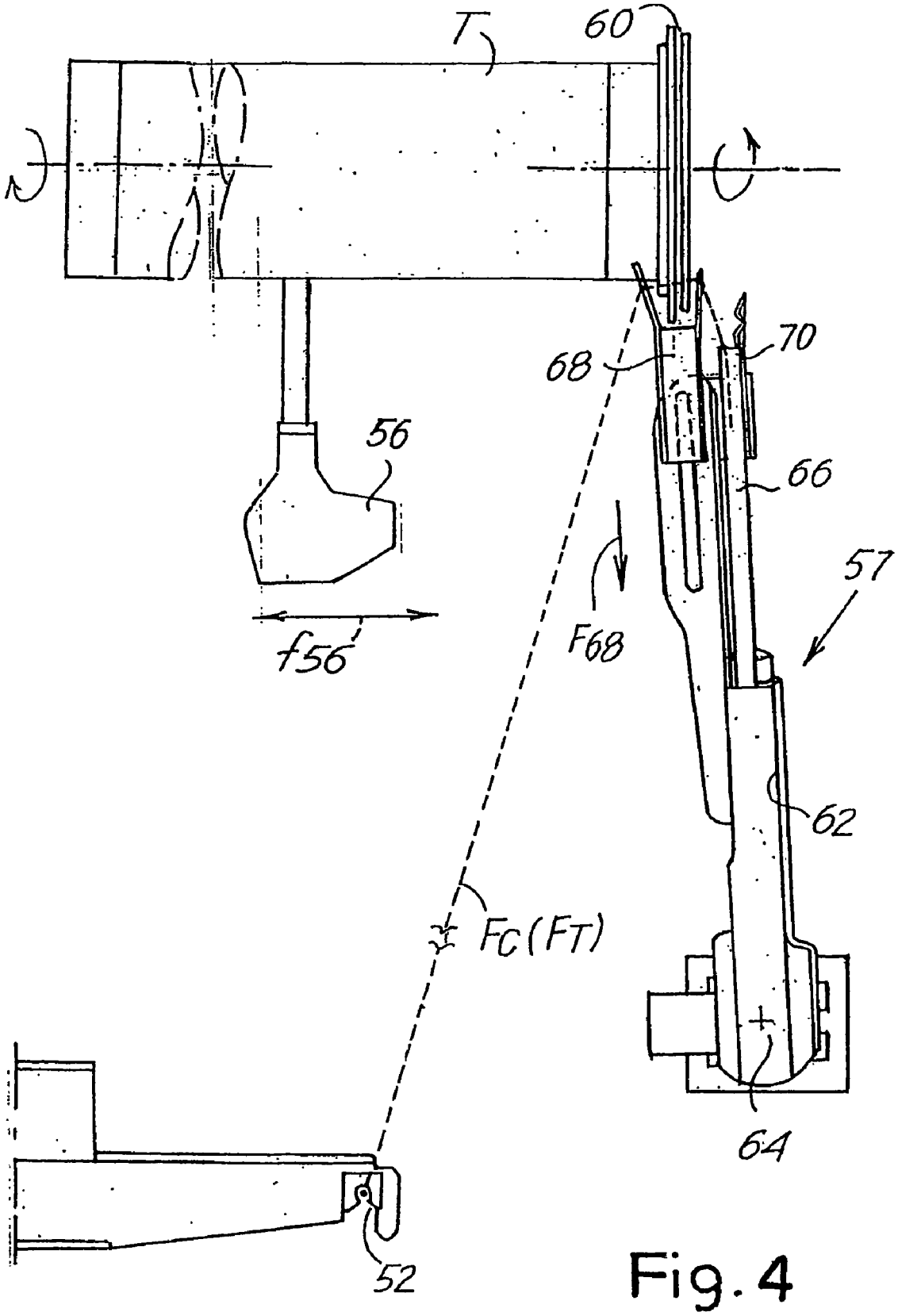
Figure 5:
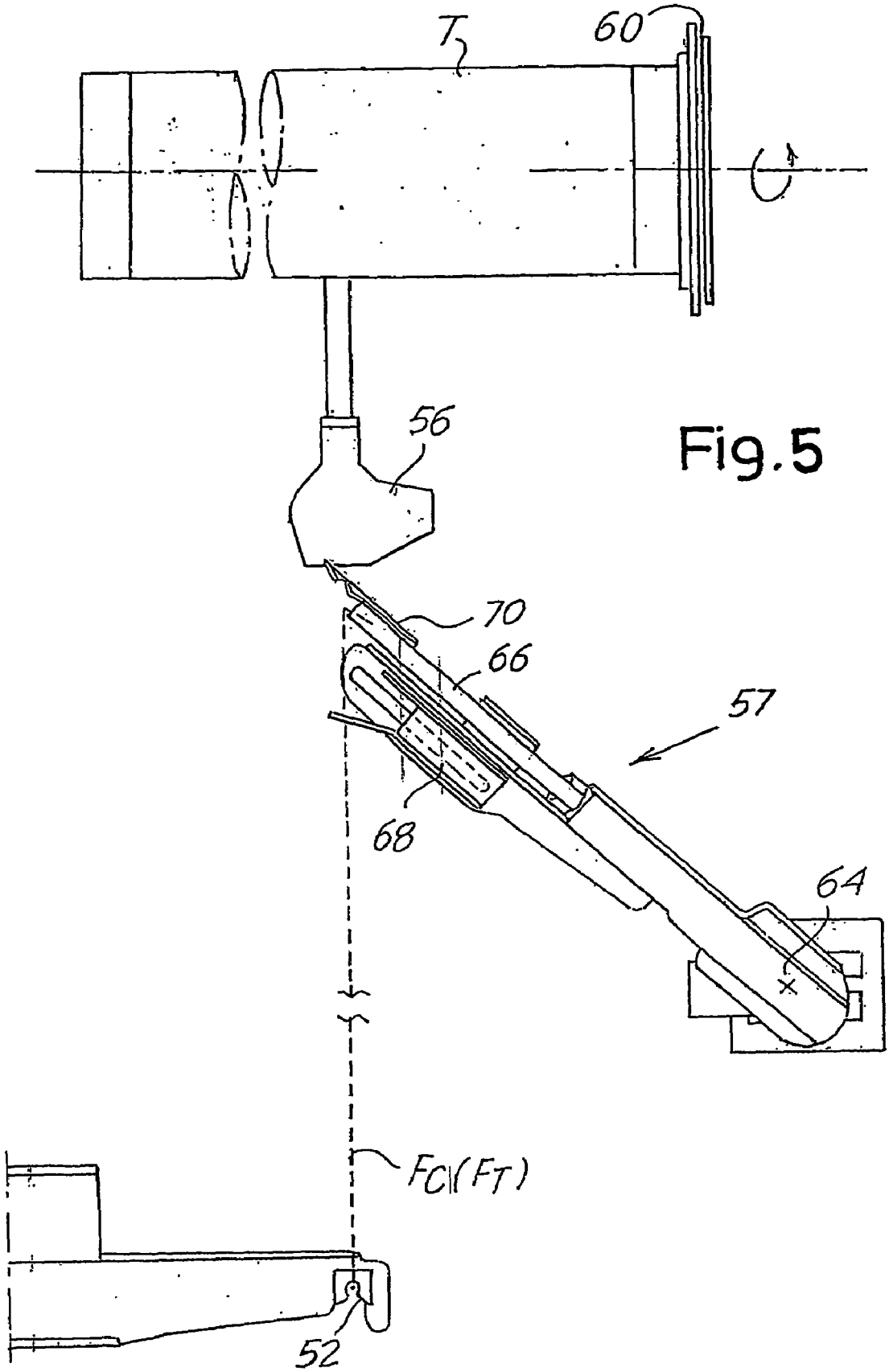

The device 57 includes an arm 62 hinged about an axis 64 approximately orthogonal to the plane in FIGS. 3, 4, 5 and which carries a frontally open suction conduit, indicated with 66, a fork 68, with a translating movement according to f68 along the arm and parallel to the suction conduit 66, and a guiding member 70 integral with the conduit 66, to draw the yarn towards the mouth of the suction conduit 66.

In the arrangement shown in FIG. 3, the yarn FC is sucked into the conduit 66. In this phase, the yarn may actually be composed only of the covering yarn FT and not of the interlaced yarn FC, as the elastic yarn F1 or F2 previously delivered from the corresponding spool R1 or R2 finishes in this phase, while the yarn FT is continuously fed even if the elastic yarn F1 or F2 is missing. However, as mentioned above, if the cop BC is replaced with a new winding tube T before the spool R1 or R2 of elastic yarn finishes (as the spool has enough yarn to produce, for example, two cops of composite yarn FC), in the phase to replace the cop BC with the tube T the device will suck composite yarn inside the conduit 66 until the new winding operation starts up.

After the yarn F1 (finished or broken) has been replaced with the yarn F2 (in the manner described in greater detail below) and the interlacing jet has started to produce composite yarn FC with the yarn F2 covered by the yarn FT, the interlaced or composite yarn FC can start to be wound on the new tube T, which for this purpose is rotated about its axis.

By means of the fork 68, the yarn FC is drawn adjacent to the ring 60, which rotates integrally with the tube and grips the yarn to wind it around said tube. The phase to draw the yarn FC adjacent to the ring 60 is shown in FIG. 4. While the yarn forms the first winding turn on the tube T, a blade (not shown) cuts the yarn to separate it from the portion thereof which is inside the suction conduit 66. This produces a free end of yarn which remains anchored to the tube through the effect of winding. By continuing to wind the yarn FC delivered to the tube T thereon, the path of the yarn FC between the guiding fork 52 and the tube T is intercepted by the thread guide 56 which engages the yarn and consequently starts to distribute it along the entire axial extension of the tube with an alternating movement according to the double arrow f56.

After winding a cop BC on the tube T, the arm 62 is brought to the position shown in FIG. 5 with the guiding member 70 disposed to intercept the path of the yarn FC drawn by the thread guide 56 in the alternating movement thereof. The guiding member 70 has a slanted surface 70A which, when intercepted by the yarn FC, makes the latter rise to the mouth of the suction conduit 66. Simultaneously, the yarn FC is cut by a blade (not shown and carried by the thread guide 56) in an intermediate position between the finished cop and the guiding member 70. The free end downstream of the cut is wound on the cop BC which is then removed, while the free end upstream of the cut is inserted into the suction conduit 66, which (as described above) starts to suck the yarn; the yarn continues to be delivered while the spool of elastic yarn is changed and the completed cop BC is replaced with a new tube. From this position, the arm 62 returns to the position in FIG. 3 standing by for a new winding process to start up as soon as the interlacing jet 19 starts to deliver the completed yarn FC again, that is, after feeding of the new elastic yarn F2 starts.

Overall operation of the device described above is illustrated below. In the configuration shown in FIG. 2, the covering yarn FT, textured upstream of the pair of rollers 7A, 7B, is fed to the stretching unit 15, 17 and from here to the interlacing jet 19. Parallel thereto, the elastic yarn F1, delivered from the spool R1 which is turned by the unwinding roller 35, is also fed to the stretching unit 15, 17 and then to the interlacing jet 19. The composite yarn FC is wound on the cop BC being formed on the winding tube T supported by arms 56 in the winding area 55. The second elastic yarn F2 is in standby position with the initial free end engaged by the retaining member 20 and deflected by the deflecting element 6 so as not to interfere with the sensor 59. The yarns F1 and FT travel through the first interlacing jet 2, which is temporarily inoperative.

The phase to exchange the spool R1 with the spool R2 and to replace the cop BC with a new tube T is started when the sensor 59 detects that the first elastic yarn F1 delivered from the spool R1 has been finished or interrupted. During this phase, the textured covering yarn FT continues to be delivered without interruption, preferably at an essentially constant speed. The sensor 59 can be replaced by another type of sensor, for example, which detects the diameter of the spool R1 about to finish or the amount of yarn F1 delivered. A sensor which detects the amount of yarn wound on the cop BC, measured according to weight and/or length, may be combined with the sensor 59 or other equivalent device. This additional sensor may be used to trigger the replacement process even when the yarn F1 is not finished but the cop BC has been completed.

The following operations are carried out during the exchange phase. The composite yarn FC is cut between the completed cop BC and the device 57, forming an head or tail end which is completely wound on the cop. The other free end formed by the cut is withheld by the device 57 and sucked by the suction mouth 66 as described above with reference to FIGS. 3-5, and prepared to start the new winding cycle. In this way, the end part of the elastic yarn F1 and the covering yarn FT, which is still fed continuously, are sucked by the suction mouth and the yarn FT is kept adequately tensioned along the entire path thereof.

The arms 37A and 37B, and consequently the finished spool R1 and the standing-by spool R2 of elastic yarn, are exchanged so that the arm 37A with the finished spool R1 is positioned at a distance from the unwinding or delivery roller 35, and the arm 37B carries the spool R2 into contact with the unwinding roller 35.

When the arm 37A has reached the final position with the finished spool R1 in the appropriate position, the operator can replace the finished spool R1, at any moment during the entire unwinding cycle of the spool R2, with a new spool of elastic yarn which will subsequently be replaced in the same manner as the spool R2 when it in turn finishes or when the yarn F2 is interrupted, for example due to accidental breakage.

Before the spool R2 starts to deliver yarn by means of the unwinding or delivery roller 35, suction is activated through the suction mouth of the retaining member 20, so that when spool R2 unwinding is activated through rotation of the delivery or unwinding roller 35, the yarn F2 starts to accumulate in or be drawn into this mouth. This phase lasts for the minimum time required for the speed of the yarn F2 to reach approximately the same value as the speed of the textured covering yarn FT, therefore for a relatively short time.

Once the two yarns F2 and FT, which are already inserted into the first interlacing jet 2, are moving at approximately the same speed, the first interlacing jet 2 is activated for a short period. The short jet of pressurized air hits the two yarns FT and F2 in the channel of the jet 2, causing them to join and the yarns therefore start to move forward together towards the second interlacing jet 19. The air jet in the interlacing jet 2 can be interrupted when the yarn F2 has been joined to the yarn FT and is drawn by the latter towards the jet 19. As soon as the yarn F2 reaches the second interlacing jet 19 production of the composite yarn FC, by the elastic yarn covered with the covering yarn FT, resumes. The second interlacing jet 19 can be temporarily deactivated before this happens, to prevent it from acting on the yarn FT passing therethrough.

The deflecting element can be retracted after the replacement cycle has started, that is, after the sensor 59 has detected interruption in the feed of elastic yarn F1. In this way the sensor starts to detect passage of the yarn F2. When the composite yarn FC reaches the device 57, this starts winding the yarn FC on a new winding tube T, and the yarn is cut, thereby interrupting suction thereof through the mouth of the suction conduit 66, as already described in greater detail with reference to FIGS. 3-5.

As is evident from the description above, the device is particularly reliable, thanks to the fact that insertion of the second elastic yarn F2 into the process takes place in a very simple way with a minimum number of moving parts. In actual fact, the only movement is the deflecting device 6, which is a very simple member with a reduced volume. Moreover, movement thereof does not require to be perfectly synchronized with exchange of the spools R1, R2, as its sole purpose is keeping the yarn F2 out of the range of the sensor 59, while the yarn F2 is joined to the yarn FT and inserted into the process jet 18 without the movement of members and in particular without movement of the interlacing jets 2 and 19. These jets can also be produced in a configuration that does not have controllable opening and closing systems for yarn insertion.

In the exemplary embodiment described above, reference was made to a machine or device provided with three pairs of feed rollers 7A, 7B; 13, 15 and 54, 56. Nonetheless, according to a different embodiment of the device, the pair of rollers 54, 56 can be eliminated, as can one of the two interlacing jets. A solution of this type is illustrated in FIG. 6, where the central part of the device, is shown, similarly to FIG. 2, while the remaining parts remain essentially unchanged with respect to what is described with reference to FIGS. 1 to 5.

Figure 6:
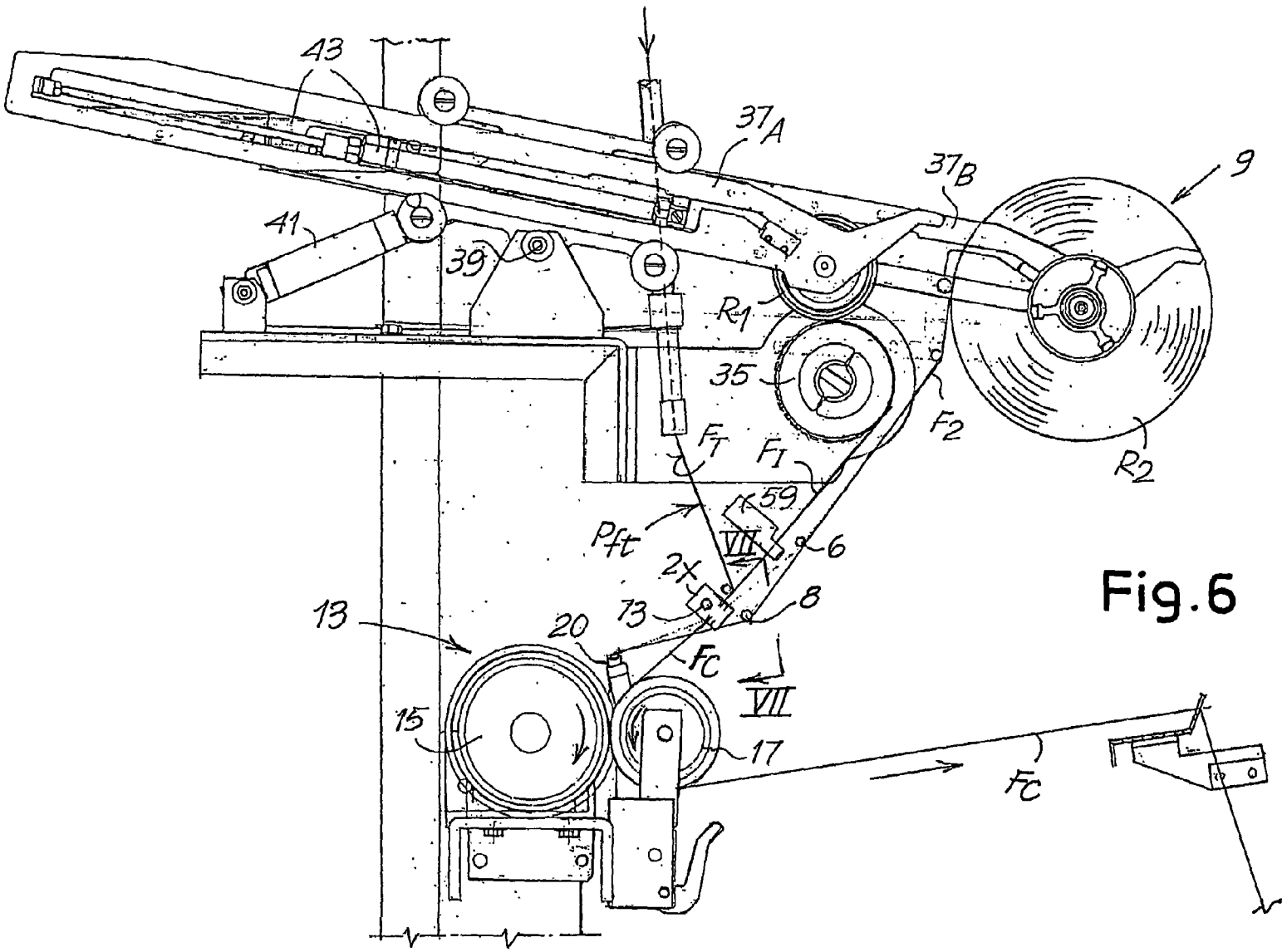
FIG. 6 shows a side view similar to the view in FIG. 2 of a modified embodiment.

In FIG. 6, the same numbers indicate parts the same as or equivalent to those in the previous figures. The interlacing jet 19 has been eliminated and only the first interlacing jet, indicated with 2X, remains along the path of the yarns, which here performs the dual operation of joining the yarns F2 and FT and covering the elastic yarn F1 or F2 with the yarn FT.

To prevent the second elastic yarn F2, standing by to replace the first elastic yarn F1 being processed, from interfering with operation of the jet 2X and with operation of the sensor 59, in this case the initial portion of the yarn F2 is withheld by a double deflecting element 6, 8. This element can consist of a pair of piston-cylinder actuators, with two deflecting members coated in a material with low coefficient of friction (typically a ceramic material) associated with the rods of the piston. The arrangement of the two deflecting members is such that by engaging the free end of the yarn F2 with the retaining member 20 and positioning the deflecting members in their active position, the initial portion of the yarn F2 is in front and out of the interlacing jet 2X. It would also be possible to use a single deflecting element 8, suitably positioned to hold the yarn F1 standing by out of the detection range of the sensor 59, and out of the inner channel of the interlacing jet 2X.

When the sensor 59 detects interruption of the first elastic yarn F1, it enables starting of the replacement cycle. As in the previous case, the covering yarn FT continues to be fed, essentially at the same speed, through the interlacing jet 2X, which may be deactivated for a part of or for the entire cycle to replace or exchange the yarns F1 and F2. The cop BC of composite yarn FC is replaced with a new tube T, while the covering yarn FT is accumulated by the suction mouth associated with the winding system of the cops BC. The position of the arms 37A, 37B is exchanged, or more precisely the arm 37B is carried with the spool R2 in contact with the unwinding or delivery roller 35, while the arm 37A is placed in a position in which the operator can easily replace the finished spool R1 with a new spool.

Once the new tube T is in position and is turning (or even slightly before this moment) start-up of feed of the yarn F2 is enabled. The mouth of the retaining member 20 sucks the yarn F2, while with a coordinated movement the deflecting element 6, 8 is taken to the retracted position, so that the yarn F2 enters the detection range of the sensor 59 and the interlacing jet 2X and the latter is activated. Synchronization of the various operations is such that the new elastic yarn F2 is engaged with the covering yarn FT and, through the jet 2X, combined feed of the yarns F2 and FT and, consequently, production of the composite yarn FC, starts.

In this second solution, the device is further simplified through elimination of the third feed unit 53, with its rollers 54 and 56. The effect of stretching and/or relaxing on the yarns being processed is obtained by coordinating the feed speeds of the feed unit 7A, 7B, of the feed unit 13 formed of the rollers 15, 17 and of the unwinding or delivery roller 35. More specifically, the elastic yarn F1 or F2 is stretched between the delivery or unwinding roller 35 and the unit 13, setting the peripheral speed of the rollers 15, 17 to a value higher than the peripheral speed of the roller 35, while the covering yarn FT can be stretched or relaxed by acting on the peripheral speed ratio of the rollers 15, 17 on the one hand and the rollers 7A, 7B on the other.

FIGS. 7A, 7B schematically show the interlacing jet 2X and the deflecting member 8. The jet 2X has a channel 71 produced in a block 72. A pressurized air nozzle fed by a compressed air line 73 is disposed transversely to the channel 72. In FIG. 7A the covering yarns FT and the first elastic yarn F1 are fed through the channel 72. The second elastic yarn F2 is in the standby position, with the initial free end engaged in the mouth of the retaining member 20. A mechanical retaining device (not shown) can be associated with the suction mouth to allow suction to remain inactive, until the phase to exchange the spools R1, R2 starts.

In this standby position the yarn F2 rests on a ceramic coated rod 8A of a piston-cylinder actuator 8B. The similar piston-cylinder actuator, forming the member 6 is not shown in FIG. 7 and is positioned above the sensor 59. In this way the yarn F2 is withheld standing by in an inlet area of the jet 2X, defined by an asymmetrical V-shaped profile, formed by sides 74, 75. In the example illustrated, through the effect of the offset position of the retaining member 20, the yarn F2 rests on the side 75. A slit which leads into the channel 71 extends from the vertex of the V-shaped profile.

When the yarn F2 is to be brought into the process, it is released from the members 6, 8 (or by the member 8 when the member 6 is not provided) and, through the effect of the tension applied by suction of the mouth associated with the retaining member 20, it is positioned at the vertex of the V-shaped profile 74, 75, passes through the slit therein and from there enters the process channel 71 of the jet 2X, to take the condition in FIG. 7B, in which the yarns FT and F2 are fed through the jet.

The same type of jet can be used as jet 2 in the configuration in FIG. 2. In this case, the yarns FT and F2, on which the jet performs no action, pass through the conduit 71, while the yarn F2 is standing by inside said conduit until the yarn F1 finishes.

It will be understood that in the configuration in FIG. 2 the second elastic yarn F2 could also be withheld standing by in front of the channel of the jet 2, with a double deflecting mechanism as in the example in FIG. 6.

Figure 8:
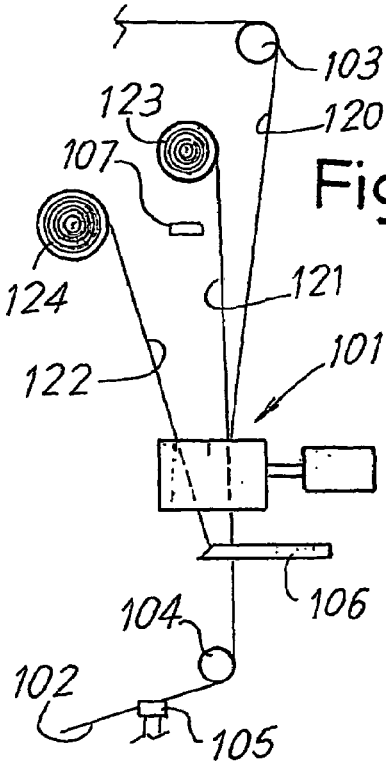
FIGS. 8, 9 and 10 diagrammatically show a further embodiment of the invention.
Figure 10:
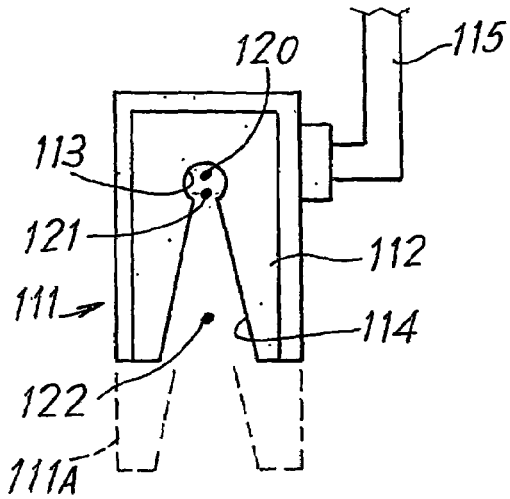
Figure 9:
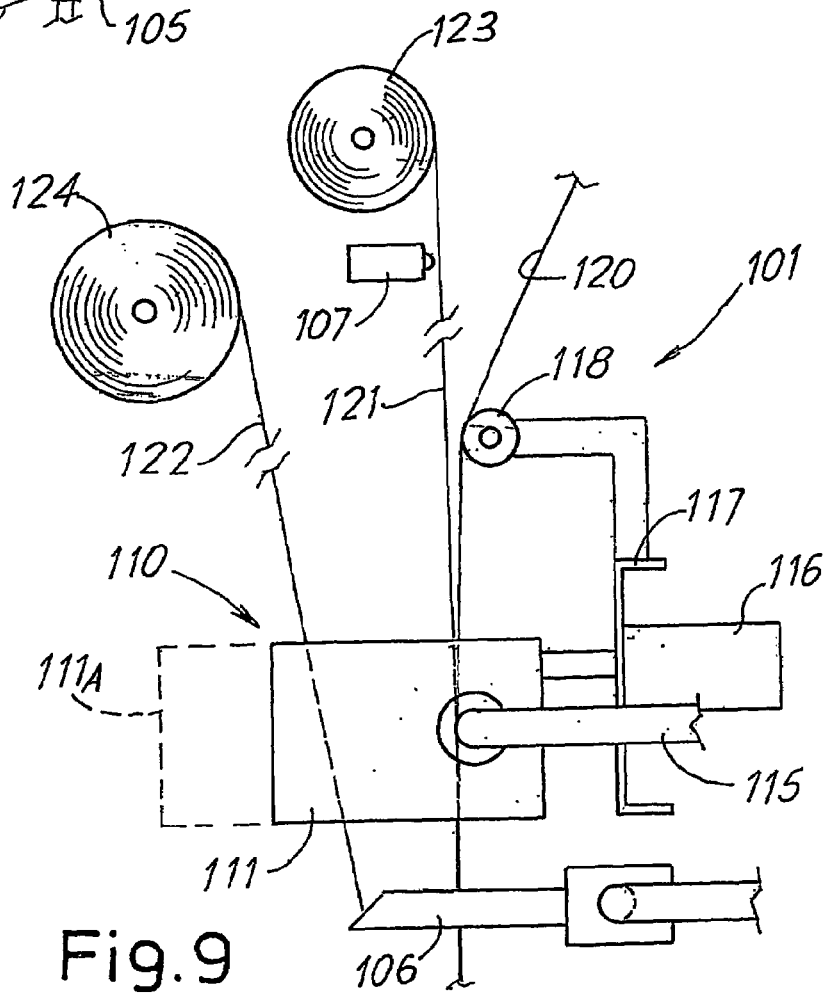

A further embodiment of the invention is shown in FIGS. 8, 9 and 10. With particular reference to said figures, number 101 indicates as a whole the device for automatic threading of the elastomer yarn in a machine for the production of interlaced composite yarns 102, starting from a covering yarn 120 and from an elastomer yarn 121.

The covering yarn 120 is unwound continuously along a path defined by a series of rollers made to rotate independently by relative spindles, comprising at least a drawing spindle 103 and a stretching spindle 104, and is fed to an air jet interlacing jet 105.

The interlacing jet 105 is simultaneously fed continuously with a first elastomer yarn 121, to obtain interlacing of the covering yarn 120 with the elastomer yarn 121, thus covering the elastomeric yarn 121 with the covering yarn. The first elastomer yarn 121 is unwound from a first spool 123 prearranged in a working position on the machine.

A second spool 124 of elastomer yarn 122 is prearranged in a stand-by position and is suitable to be transferred to the aforesaid working position upon interruption of feed of the first elastomer yarn 121, by any suitable means, such as the ones described in more detail with respect to the previous figures.

According to the present invention, the free end of the second elastomer yarn 122 is withheld, in a retaining area upstream of the interlacing device 105, by a tubular retention member 106 suitable to be connected to appropriate suction means.

It must be observed that the second elastomer yarn 122 is unwound linearly from the second spool 124 to the inlet of the suction member 106, disposed in said retaining area, in which the free end of the yarn 122 is withheld.

Arranged in proximity to the retaining area of the free end of the second elastomer yarn 122, in practice immediately above the suction member 106, is a coupling member 110 through which the covering yarn 120 and the first elastomer yarn 121 are conveyed continuously, to be fed together to the air jet interlacing device 105.

Substantially, said coupling member 110 is an interlacing jet composed in substance by an operating head 111 bearing a fork 112 which defines a through channel 113, with a vertical axis, for the yarns 120 and 121; the channel 113 of the interlacing jet 110 is open at the front for insertion of said yarns 120, 121. The fork 112 is preferably made of a ceramic material.

In particular, the fork 112 shapes a flared inlet 114, prearranged at the level of which is the portion of the second elastomer yarn 122 which is unwound linearly from the second spool 124 to the suction member 106 which retains its free end.

Associated with the operating head 111 is a conduit 115 to deliver a pressurized air jet, suitable to be connected to conventional means for compressed air feed. The conduit 115 leads transversely into the channel 113, by an appropriate hole produced transversely to the fork 112.

The operating head 111 is suitable to be made to move in a horizontal direction by an alternate actuator member 116, for example a pneumatic cylinder, connected to a support 117 fixed to the frame of the machine. This support 117 also has a deflecting roller 118, freely rotating, suitable to prearrange the covering yarn 120 according to a vertical direction essentially aligned with the axis of the channel 113 of the fork 112.

Moreover, a sensor member 107 is positioned above the interlacing jet 110. The sensor member 107 is suitable to detect interruption of feed of the first elastomer yarn 121, to control transfer of the second spool 124 of elastomer yarn to the working position and corresponding transfer of the first spool 123 of elastomer yarn to the stand-by position.

The method for automatic change of the elastomer yarn is easily understandable from the description above.

During normal operating conditions of the machine, the covering yarn 20 and the first elastomer yarn 121, being unwound from the relative spool 123 disposed in the working position, are conveyed parallel through the interlacing jet 110, 111 and then fed together to the second interlacing jet 105. The second elastomer yarn 122, the first portion of which has been unwound from the relative spool 124 is disposed in the stand-by position, and its free end is retained by the suction member 106, positioned slightly below the interlacing jet 110, 111.

It must be noted that, in this condition, the portion of the second elastomer yarn 122 which extends from the second spool 124 to the suction member 106 is disposed at the level of the flared inlet 114 of the fork 112 of the interlacing jet 110, 111.

When the sensor member 107 detects interruption in the feed of the first elastomer yarn 121, due to the spool 123 finishing or the yarn breaking, it controls, in appropriate time relationship, transfer of the second spool 124 of elastomer yarn to the working position and corresponding transfer of the first spool 123 of elastomer yarn to the stand-by position. It should be understood, however, that both in this embodiment as well as in the previous ones, that the stand-by and working positions of the two elastic yarn spools might be fixed, i.e. the position might not change when the yarn is put into the process.

Simultaneously, by means of the alternate actuator member 116, movement of the interlacing jet 110, 111 is performed in the direction transverse to the direction of feed of the yarns, so as to come into contact with the second elastomer yarn 122.

In practice, the head 111 moves linearly between a withdrawn position, occupied in normal operating conditions to feed the yarns to the interlacing jet 105, and a forward position, indicated with the dashed line 111*a*, in which the second yarn 122 is inserted in the channel 113 of the fork 112 of the head 111. In this forward position, by means of the conduit 115, a pressurized air jet is delivered to the interlacing jet 110, 111 to join the second elastomer yarn 122 with the covering yarn 120. Simultaneously, the free end of the second elastomer yarn 122 is released by the suction member 106.

The interlacing jet 110, 111 is then moved again to the withdrawn position of normal operation, to resume feed of the yarns 120, 122 to the interlacing jet 105.

The method and device described thus attain the object of performing, in a safe and efficient way, automatic threading of the elastomer yarn in machines for the production of interlaced yarns, in particular avoiding possible breakages of the elastomer yarn.

In fact, the elastomer yarn disposed in the stand-by position is unwound linearly for a short portion from the relative spool to the suction member which withholds the free end, in an area relatively far from the interlacing device 105. At the moment of automatic change of the spool, this elastomer yarn is therefore not subject to handling, rubbing or other steps which could cause breakage thereof.

This arrangement also considerably facilitates periodic arrangement of the spool of elastomer yarn in the stand-by position, it being sufficient for the free end of this yarn to be taken to the level of the inlet of the suction member using conventional instruments.

A peculiarity of the method and of the device according to the present invention is constituted by the fact that when the spools are changed the new elastomer yarn is joined locally with a pressurized air jet to the covering yarn, which advances continuously, so that parallel feed of the two yarns to the interlacing device resumes immediately.

Obviously, it is possible for insertion of the elastomer yarn to be performed with the machine stopped, as well as with the machine running.

The means for replacing the cop of composite yarn are not shown in FIGS. 8, 9 and 10: they can be designed as in the previous embodiments.

It is understood that the drawing only shows practical embodiments of the invention, which may vary in forms and arrangements, without however departing from the scope on which the invention is based.

The invention claimed is:

1. A method for the production of a composite yarn and for automatic replacement of spools of elastic yarn, the method comprising the steps of:

feeding covering yarn along a feed path such that said covering yarn passes through at least a first interlacing jet;

delivering a first elastic yarn from a first spool such that said first elastic yarn passes through the first interlacing jet;

coating the first elastic yarn with said covering yarn to form composite yarn and winding the composite yarn on a cop;

arranging a second spool of a second elastic yarn in a stand-by position;

withholding an initial portion of said second elastic yarn in an area of said first interlacing jet;

replacing the cop of composite yarn with a new tube when delivery of said first elastic yarn is interrupted;

releasing said initial portion of the second elastic yarn after delivery of said first elastic yarn is interrupted;

automatically replacing said first spool of elastic yarn with said second spool of elastic yarn when delivery of said first elastic yarn is interrupted joining said covering yarn and said second elastic yarn via the first interlacing jet to resume forming said composite yarn; and winding the composite yarn on said new tube after said second elastic yarn has been covered with said covering yarn.

2. Method as claimed in claim 1, wherein the initial portion of the second elastic yarn is withheld by a retaining member.

3. Method according to claim 2, wherein:

said initial portion of the second elastic yarn is engaged by a deflecting element; and said deflecting element is controlled to release said initial portion of the second elastic yarn.

4. Method as claimed in claim 3, wherein said deflecting element withholds said second elastic yarn such that said second elastic yarn does not enter the first interlacing jet, the second elastic yarn being disposed to be inserted automatically into said first interlacing jet when said deflecting element releases said second elastic yarn.

5. Method as claimed in claim 4, wherein said second elastic yarn is inserted into the first interlacing jet via tension exerted by the retaining member.

6. Method as claimed in claim 1, wherein the second elastic yarn is inserted into said first interlacing jet and withheld therein until said delivery of said first elastic yarn is interrupted.

7. Method as claimed in claim 1, wherein said retaining member withholds said initial free end at least partly by suction.

8. Method as claimed in claim 1, wherein feed of the second elastic yarn starts before joining to said covering yarn.

9. Method as claimed in claim 7, wherein the second elastic yarn delivered before joining to the covering yarn is sucked by said retaining member.

10. Method as claimed in claim 1, wherein the covering yarn and the elastic yarn pass through a nip, defined by a pair of rollers downstream of said first interlacing jet.

11. Method as claimed in claim 1, wherein the composite yarn passes through a nip defined by a pair of rollers.

12. Method as claimed in claim 1, wherein said elastic yarn is covered with said covering yarn via said first interlacing jet.

13. Method as claimed in claim 12, wherein:

when delivery of said first elastic yarn is interrupted, said first interlacing jet is temporarily made to stop operating while the covering yarn continues to be fed therethrough;

after the second elastic yarn from the second spool starts to be delivered through the first interlacing jet, said first interlacing jet is re-activated to join the second elastic yarn to said covering yarn and resume production of said composite yarn.

14. Method as claimed in claim 13, wherein said second elastic yarn is already standing by inside the first interlacing jet when feed of the first elastic yarn is interrupted.

15. Method as claimed in claim 1, wherein said elastic yarn is covered with said covering yarn by a second interlacing jet, disposed downstream of the first interlacing jet along the path of the covering yarn.

16. Method as claimed in claim 15, wherein said first interlacing jet is temporarily activated to join the covering yarn and the second elastic yarn and subsequently de-activated, while the second interlacing jet remains active at least to produce the composite yarn covering the elastic yarn with the covering yarn.

17. Method as claimed in claim 16, wherein said second interlacing jet is temporarily deactivated between interruption of feed of the first elastic yarn and start of feed of the second elastic yarn.

18. Method as claimed in claim 15, wherein when delivery of said first elastic yarn is interrupted, the covering yarn is fed through the first inoperative interlacing jet; after delivery of the second elastic yarn from the second spool starts, the first interlacing jet is temporarily activated to join the second elastic yarn to said covering yarn and subsequently deactivated.

19. Method as claimed in claim 12, wherein:

said covering yarn is fed through a first nip between a pair of rollers, at least one of which is driven, and through said first interlacing jet;

the composite yarn delivered from said first interlacing jet is fed to a second nip between a second pair of rollers;

said second pair of rollers has a lower peripheral speed with respect to said first pair of rollers to relax the covering yarn between said second nip and said first nip; and the elastic yarn is fed by a delivery roller through said first interlacing jet, the delivery roller having a lower delivery speed than the speed of said second pair of rollers, to subject said elastic yarn to a stretching effect between said second nip and said delivery roller.

20. Method as claimed in claim 1, wherein said covering yarn is a textured yarn, preferably a multiple filament textured yarn.

21. Method as claimed in claim 20, wherein said covering yarn is textured in line upstream of said first interlacing jet.

22. Method according to claim 1, further comprising the steps of:

continuously feeding said covering yarn to a second interlacing jet;

simultaneously feeding to said second interlacing jet said first elastic yarn, said first elastomer yarn being unwound from said first spool, disposed in a working position, such that said covering yarn is interlaced with said first elastic elastomer yarn;

withholding a free end of said second elastic yarn, wound on said second spool, disposed in a stand-by position, in a retaining area;

detecting interruption of feed of said first elastic yarn, to control, in appropriate time relationship, transfer of said second spool of elastic yarn to said working position and transfer of said first spool of elastic yarn to said stand-by position;

performing a relative movement of said covering yarn with respect to said second elastic yarn, in proximity to said retaining area of said free end of the second elastic yarn, such that said covering yarn contacts said second elastic yarn; and associating said second elastic yarn with said covering yarn using said first interlacing jet, simultaneously releasing said free end of the second elastic yarn, to resume feed of said yarns to said second interlacing jet.

23. Method as claimed in claim 22, wherein said second elastic yarn is unwound linearly from said second spool to said retaining area, positioned upstream of said second interlacing jet.

24. Method as claimed in claim 22, wherein said free end of the second elastic yarn is withheld in the retaining area by suctions means.

25. Method as claimed in claim 22, wherein said covering yarn and said first elastic yarn are conveyed continuously through said first interlacing jet such that alternate motion is created via said first interlacing jet in a direction transverse to the direction of feed of said yarns, whereby said covering yarn contacts said second elastic yarn.

26. A device for the production of a composite yarn, the device comprising:

a first interlacing jet;

a covering yarn feed path extending toward said first interlacing jet;

an elastic yarn feed path extending toward said first interlacing jet, said covering yarn and said elastic yarn forming composite yarn;

supporting means for arranging at least a first spool of elastic yarn and at least a second spool of elastic yarn;

winding members winding the composite yarn on a cop being formed;

an interruption device, said interruption device interrupting feed of the composite yarn to said cop being formed, said interruption device starting winding the composite yarn on a new winding tube;

a retaining member associated with said first interlacing jet to withhold an initial free end of the elastic yarn of said second spool;

a sensor detecting interruption of feed of said first elastic yarn to said first interlacing jet;

a control element controlling release of said initial free end of the elastic yarn of said second spool when said sensor detects an interruption in the feed of the first elastic yarn to said first interlacing jet.

27. Device as claimed in claim 26, wherein said retaining member is a suction member.

28. Device according to claim 26, further comprising a deflecting element arranged to withhold an initial portion of said second elastic yarn during delivery of the first elastic yarn to the first interlacing jet.

29. Device as claimed in claim 28, wherein:

said retaining member and said deflecting element are disposed, with respect to said first interlacing jet, such that said retaining member and said deflecting element withhold the second elastic yarn in a position outside of said interlacing jet; and the retaining member maintains said second elastic yarn in tension such that said second elastic yarn is inserted into said first interlacing jet when the deflecting element releases said second elastic yarn.

30. Device as claimed in claim 26, wherein said first interlacing jet includes an air jet, said elastic yarn being covered with covering yarn via said air jet.

31. Device as claimed in claim 30, further comprising:

a first pair of drawing rollers defining a first nip along the feed path of the covering yarn upstream of said first interlacing jet; and a second pair of drawing rollers defining a second nip, downstream of said first interlacing jet, and wherein said second pair of rollers are controlled such that said second pair of rollers rotate at a lower peripheral speed than a peripheral speed of said first pair of rollers.

32. Device as claimed in claim 31, further comprising a delivery roller to deliver the elastic yarn, wherein a delivery speed of said delivery roller is lower than the peripheral speed of the rollers of said second pair.

33. Device as claimed in claim 28, wherein said retaining member and said deflecting element are disposed, with respect to said first interlacing jet, such that the second elastic yarn is located inside said first interlacing jet.

34. Device as claimed in claim 26, wherein a second interlacing jet is located downstream of said first interlacing jet, said elastic yarn and said covering yarn being delivered to said second interlacing jet, said second interlacing jet covering the elastic yarn with the covering yarn.

35. Device as claimed in claim 34, wherein said first interlacing jet is controlled such that said first interlacing jet is activated only temporarily to join the second elastic yarn to the covering yarn.

36. Device as claimed in claim 34, wherein a third pair of drawing rollers are disposed downstream of said second interlacing jet, said third pair of drawing rollers defining a nip through which the composite yarn delivered from the second interlacing jet passes.

37. Device as claimed in claim 26, further comprising a texturing station for said covering yarn.

38. Device as claimed in claim 26, wherein said supporting means maintains said first spool in a working position and said second spool in a standby position, said support means automatically removing the first spool from said working position and transferring the second spool from the standby position to the working position when feed of said first elastic yarn is interrupted.

39. Device as claimed in claim 26, wherein said supporting means of the first and of the second spool of elastic yarn are controlled such that a replacement cycle of the first spool of elastic yarn with the second spool of elastic yarn is started following interruption of feed of the first elastic yarn.

40. Device as claimed in claim 39, wherein said sensor detects the end of the elastic yarn of said first spool.

41. Device as claimed in claim 26, wherein said first interlacing jet is movable such that the second elastic yarn enters said first interlacing jet via movement of said first interlacing jet.

42. Device as claimed in claim 41, wherein said first interlacing jet is movable from a withdrawn position to a forward position in a direction transverse to a direction of feed of said yarns, wherein said first interlacing jet is activated to join said second elastic yarn to said covering yarn.

43. Device as claimed in claim 26, further comprising a collecting member, said collecting member collecting the covering yarn delivered between interruption of the first elastic yarn and start of delivery of the composite yarn formed with the second elastic yarn.

44. Device as claimed in claim 43, wherein said collecting member comprises a suction member.

45. Device as claimed in claim 26, wherein an oven is disposed along the path of said covering yarn upstream of said first interlacing jet.

46. A method for the production of a composite yarn and for automatic replacement of spools of elastic yarn, the method comprising the steps of:

feeding covering yarn along a feed path to a first interlacing jet;

delivering a first elastic yarn from a first spool to the first interlacing jet;

coating the first elastic yarn with said covering yarn to form composite yarn;

winding the composite yarn on a cop;

arranging a second spool of a second elastic yarn in a stand-by position;

holding an initial portion of said second elastic yarn in an area of said first interlacing jet;

replacing the cop of composite yarn with a new tube after delivery of said first elastic yarn is interrupted;

releasing said initial portion of the second elastic yarn after delivery of said first elastic yarn is interrupted, said first spool of elastic yarn being automatically replaced with said second spool of elastic yarn when delivery of said first elastic yarn is interrupted, wherein the feed of covering yarn to said first interlacing jet decreases or stops when said first spool of elastic yarn is automatically replaced with said second spool of elastic yarn;

joining said covering yarn and said second elastic yarn via the first interlacing jet to resume forming said composite yarn; and winding the composite yarn on said new tube after said second elastic yarn has been covered with said covering yarn.

* * * * *